US007938581B2

(12) United States Patent
Ping

(10) Patent No.: US 7,938,581 B2
(45) Date of Patent: May 10, 2011

(54) VACUUM SEALING BAG

(76) Inventor: Lau Kong Ping, Kowloon (HK)

( * ) Notice: Subject to any disclaimer, the term of this patent is extended or adjusted under 35 U.S.C. 154(b) by 769 days.

(21) Appl. No.: 11/985,727

(22) Filed: Nov. 15, 2007

(65) Prior Publication Data

US 2008/0137996 A1 Jun. 12, 2008

Related U.S. Application Data

(63) Continuation-in-part of application No. 10/830,992, filed on Apr. 22, 2004, now abandoned.

(51) Int. Cl.
*B65D 30/01* (2006.01)
*B65D 33/00* (2006.01)

(52) U.S. Cl. ..... 383/100; 383/105

(58) Field of Classification Search ..... 383/100–103, 383/105, 109

See application file for complete search history.

(56) References Cited

U.S. PATENT DOCUMENTS 6,715,644 B2 * 4/2004 Wilford ..... 222/95
6,799,680 B2 * 10/2004 Mak ..... 206/524.8
7,534,039 B2 * 5/2009 Wu ..... 383/105
7,757,857 B2 * 7/2010 Liang ..... 206/524.8
2003/0102245 A1 * 6/2003 Wang ..... 206/524.8
2003/0155269 A1 * 8/2003 Lee ..... 206/524.8
2004/0050745 A1 * 3/2004 Lee et al. ..... 206/524.8
2006/0072860 A1 * 4/2006 Wu ..... 383/101

FOREIGN PATENT DOCUMENTS

WO WO 2005058699 A2 * 6/2005

* cited by examiner

*Primary Examiner* — Jes F Pascua

(74) *Attorney, Agent, or Firm* — Raymond Y. Chan; David and Raymond Patent Firm

(57) ABSTRACT

A vacuum sealing bag includes first and second bag panels overlappedly affixed in an edge to edge manner to form a storing cavity between the first and second bag panels and an opening communicating with the storing cavity, and an air sealing arrangement having a plurality of first air channels longitudinally formed on an inner side of the first bag panel and a plurality of second air channels transversely formed on an inner side of the second bag panel in such a manner that when the inner side of the first bag panel is overlapped on the inner side of the second bag panel, the first air channels are communicatively intersected with the second air channels for guiding air within the storing cavity to outside, so as to air-seal the storing cavity in a vacuum manner.

6 Claims, 15 Drawing Sheets

VACUUM SEALING BAG

CROSS-REFERENCE OF RELATED APPLICATION

This is a Continuation-In-Part application of a non-provisional application having an application Ser. No. 10/830,992 and a filing date of Apr. 22, 2004, now abandoned.

BACKGROUND OF THE PRESENT INVENTION

1. Field of Invention

The present invention relates to a packing bag, and more particularly to a vacuum sealing bag, wherein air can be completely extracted from the vacuum sealing bag so as to pack the item in the vacuum sealing bag in a vacuum manner.

2. Description of Related Arts

Vacuum packing bags are commonly used for sealedly packing an item, such as food or cloth, such that the item can be packed in a vacuum manner. A conventional vacuum packing bag comprises two bag panels overlappedly mounted edges to edges to form a storing chamber such that when the item is disposed in the storing chamber, a vacuuming device is arranged to connect to the vacuum packing bag to extract the air within the storing chamber.

Accordingly, since the air within the storing chamber is extracted, the vacuum packing bag provides a vacuum environment for the item to minimize the size of the item and prevent the growth of bacterial. For example, the volume of the cloth can be minimized by extracting the air therefrom for easily storage. Another usage for the storing chamber is to pack the food such that when the air is extracted from the vacuum packing bag, the food is preserved to prevent the growth of bacterial.

However, the conventional vacuum packing bag has a major drawback that the air cannot be completely extracted from the storing chamber. Due to the irregular shape of the item, a certain amount of air is trapped within a corner or between the bag panel and the item during vacuuming. It is difficult for the user to remove the air bubble within the storing chamber while the air bubble is formed between the bag panels in an air sealed manner. Therefore, it is unsafe to preserve the food once the air is stayed within the storing chamber. In other words, the vacuum packing bag cannot achieve its original function to pack the item in a vacuum manner.

U.S. Pat. No. 4,756,422, owned by Kristen, discloses an improved vacuum packing bag which comprises two bag panels defining the storing chamber therebetween wherein a plurality of protuberances having a waffle shaped formed on one of the bag panels to define a plurality of intercommunicating channels in such a manner that the air within the storing chamber can be extracted through the intercommunicating channels to prevent the air bubble forming between the bag panels.

However, due to the waffle shaped protuberances, the air will be extracted from the storing chamber turbulently along the intercommunicating channels. Therefore, the time required for completely extracting the air will be substantially prolonged. In addition, another bag panel without the protuberances will seal on the surface of the item such that air bubble will formed between the surface of the item and the bag panel.

SUMMARY OF THE PRESENT INVENTION

A main object of the present invention is to provide a vacuum sealing bag, wherein air can be completely extracted from the vacuum sealing bag so as to pack the item in the vacuum sealing bag in a vacuum manner.

Another object of the present invention is to provide a vacuum sealing bag, wherein a plurality of first air channels are longitudinally formed on one of the bag panel while a plurality of second channels are transversely formed on the other bag panel in such a manner that when the two bag panels are overlapped, the first and second air channels are communicated with each other while the air within the vacuum sealing bag can be completely extracted to outside along the first and second air channels.

Another object of the present invention is to provide a vacuum sealing bag, wherein when an item is packed between the two bag panels, the first and second air channels are either communicated with each other or in contact with the surfaces of the item. Therefore, no air bubble is formed either at the corner of the storage cavity or between the surface of the item and the bag panel.

Another object of the present invention is to provide a vacuum sealing bag, wherein the air is guided to flow along the first and second air channels to outside such that no turbulent flow is formed between the bag panels so as to effectively extract the air from the storing cavity.

Another object of the present invention is to provide a vacuum sealing bag, which is adapted for incorporating with any vacuum device to extract the air from the vacuum sealing bag.

Another object of the present invention is to provide a vacuum sealing bag, which does not require altering the original structure of the bag panel so as to reduce the manufacturing cost of the vacuum sealing bag with built-in first and second air channels.

Another object of the present invention is to provide a vacuum sealing bag, wherein no expensive or mechanical structure is required to employ in the present invention in order to achieve the above mentioned objects. Therefore, the present invention successfully provides an economic and efficient solution not only for providing a quick air-sealing configuration of the vacuum sealing bag but also for enhancing the practice use of the vacuum sealing bag.

Accordingly, in order to accomplish the above objects, the present invention provides a vacuum sealing bag, comprising:

first and second bag panels overlappedly affixed in an edge to edge manner to form a storing cavity between the first and second bag panels and an opening communicating with the storing cavity; and an air sealing arrangement having a plurality of first air channels longitudinally formed on an inner side of the first bag panel and a plurality of second air channels transversely formed on an inner side of the second bag panel in such a manner that when the inner side of the first bag panel is overlapped on the inner side of the second bag panel, the first air channels are communicatively intersected with the second air channels for guiding air within the storing cavity to outside, so as to air-seal the storing cavity in a vacuum manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
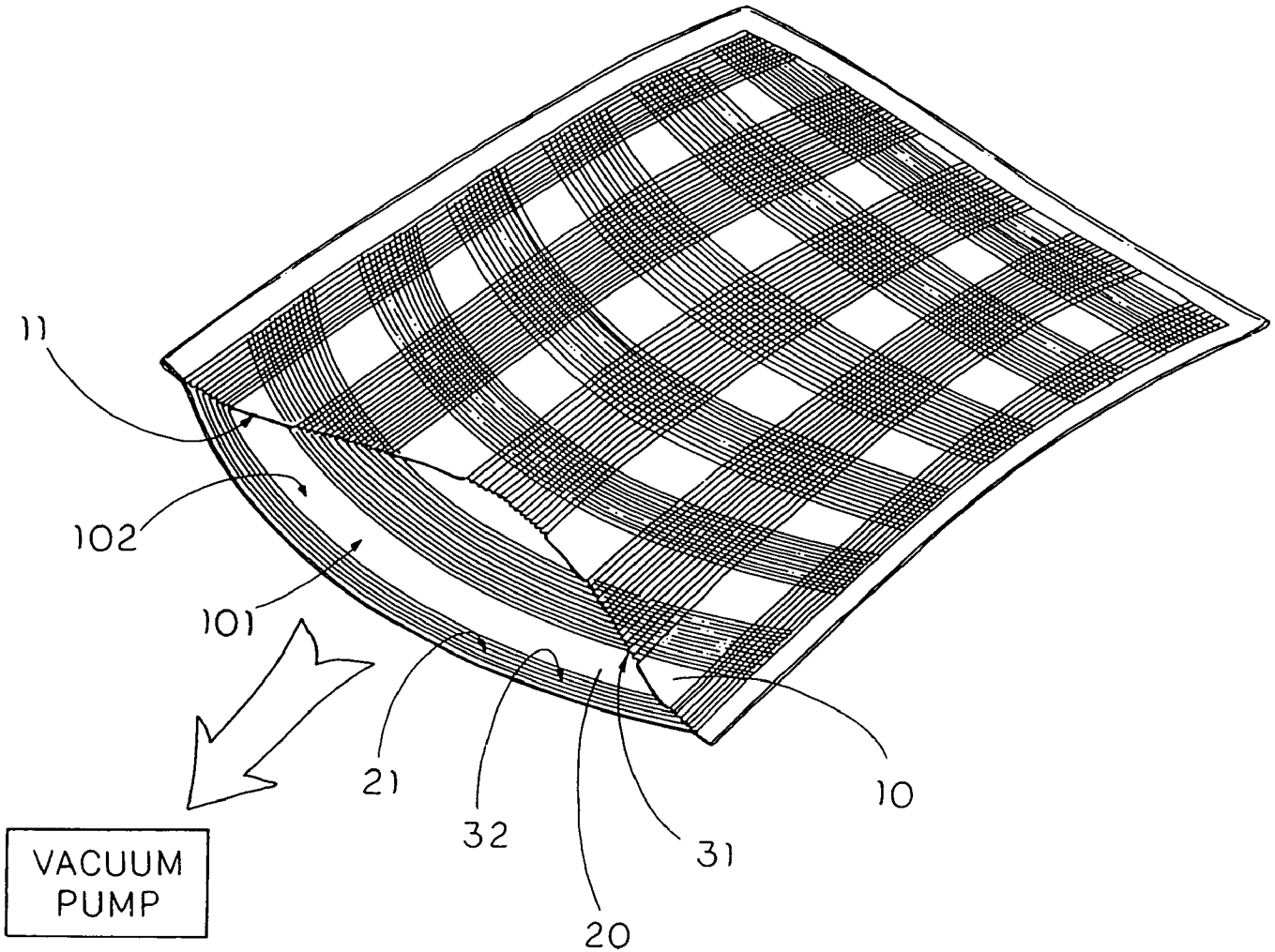
FIG. 1 is a perspective view of a vacuum sealing bag according to a preferred embodiment of the present invention.

Referring to FIG. 1 of the drawings, a vacuum sealing bag according to a preferred embodiment of the present invention is illustrated, wherein the vacuum sealing bag comprises first and second bag panels 10, 20 overlappedly affixed in an edge to edge manner to form a storing cavity 101 between the first and second bag panels 10, 20 and an opening 102 communicating with the storing cavity 101.

The vacuum sealing bag further comprises an air sealing arrangement 30 having a plurality of first air channels 31 longitudinally formed on an inner side 11 of the first bag panel 10 and a plurality of second air channels 32 transversely formed on an inner side 21 of the second bag panel 20 in such a manner that when the inner side 11 of the first bag panel 10 is overlapped on the inner side 21 of the second bag panel 20, the first air channels 31 are communicatively intersected with the second air channels 32 for guiding air within the storing cavity 101 to outside, so as to air-seal the storing cavity 101 in a vacuum manner.

According to the preferred embodiment, each of the first and second bag panels 10, 20 is made of air impermeable material to prevent the air entering into the storing cavity 101 after the storing cavity 101 is air-sealed between the first and second bag panels 10, 20. As shown in FIG. 1, a peripheral edge portion of the first bag panel 10 is sealedly affixed to a peripheral edge portion of the second bag panel 20 to form the storing cavity 101 between the inner sides 11, 21 of the first and second bag panels 10, 20 while one edge of the first bag panel 10 is unsealed to the second bag panel 20 to form the opening 102 to communicate with the storing cavity 101.

The first and second air channels 31, 32 are spacedly formed on the inner sides 11, 21 of the first and second bag panels 10 respectively, wherein each of the first and second air channels 31, 32 is communicating with the storing cavity 101 for guiding the direction of airflow within the storing cavity 101 to outside.

The first air channels 31 are parallelly extended on the inner side 11 of the first bag panel 10 from edge to edge and the second air channels 32 are parallelly extended on the inner side 21 of the second bag panel 20 from edge to edge such that when the inner side 11 of the first bag panel 10 is overlapped on the inner side 21 of the second bag panel 20, the first air channels 31 are intercommunicated with the second air channels 32 in a crisscross manner so as to allow the air to flow therebetween.

Accordingly, a plurality of grooves are longitudinally and transversely indented on the inner sides 11, 21 of the first and second bag panels 10, 20 to form the first and second air channels 31, 32 respectively, such that the first and second air channels 31, 32 are integrally formed on the inner sides 11, 21 of the first and second bag panels 10, 20 respectively.

Figure 2:
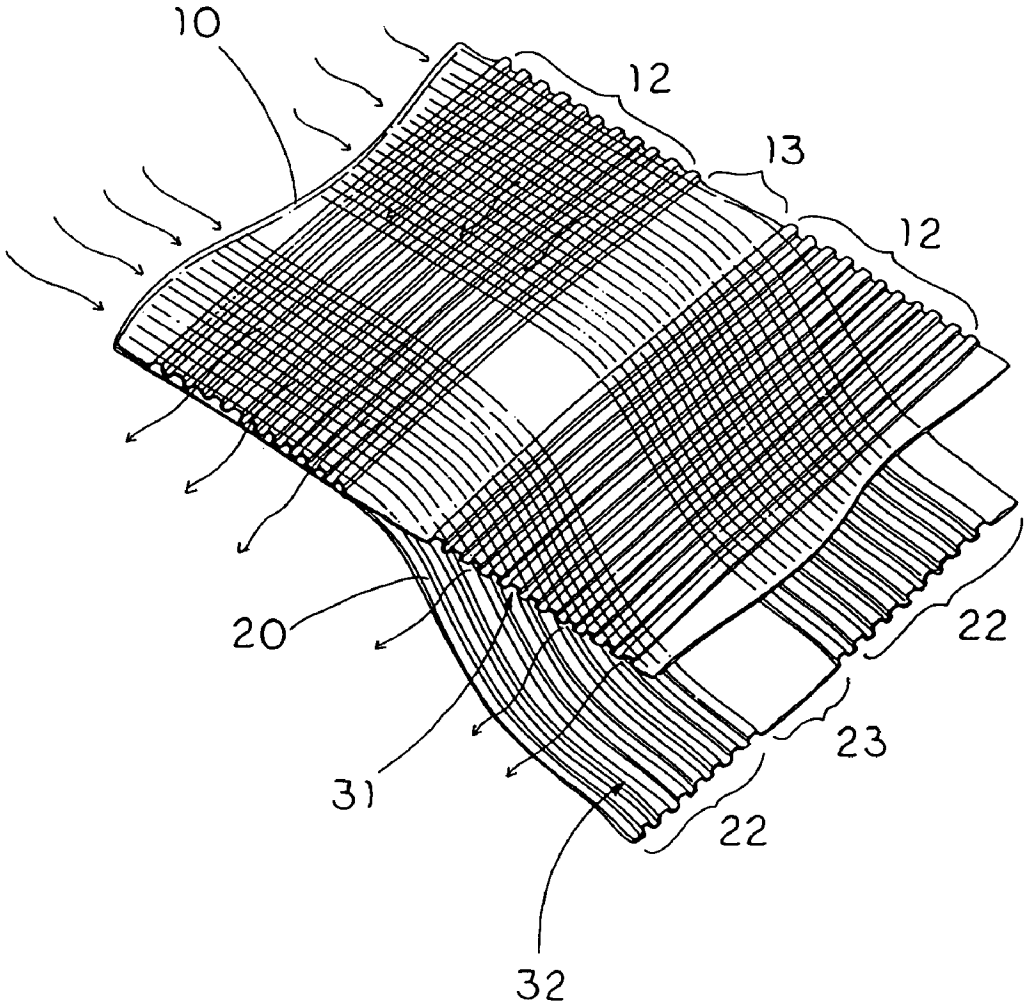
FIG. 2 is a partially perspective view of the air sealing arrangement of the vacuum sealing bag according to the above preferred embodiment of the present invention.
Figure 3:
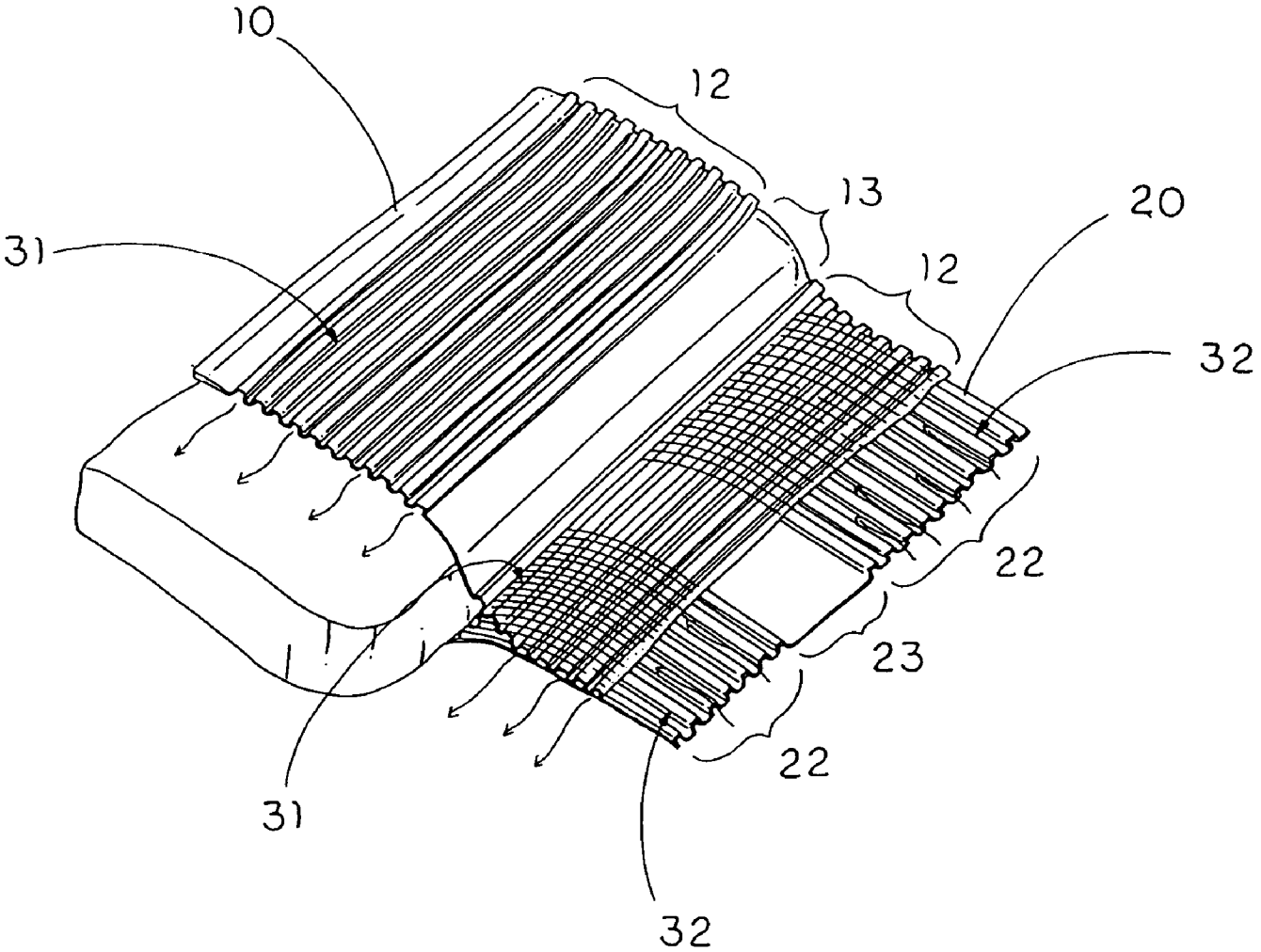
FIG. 3 is a partially perspective view of the vacuum sealing bag according to the above preferred embodiment of the present invention, illustrating an item placed in the vacuum sealing bag in an air sealed manner.

As shown in FIGS. 1 and 2, the first and second air channels 31, 32 are perpendicular to each other such that when the first air channels 31 are intersected with the second air channels 32, the air within the storing cavity 101 is allowed to efficiently flow between the first and second air channels 31, 32.

The first bag panel 10 has a plurality of longitudinal guiding portions 12 and a plurality of longitudinal sealing portions 13 each formed between each two longitudinal guiding portions 12 wherein each of the longitudinal sealing portions 13 of the first bag panel 10 has a flat sealing surface for sealedly contacting with an item within the storing cavity 101 while the first air channels 31 are spacedly formed at the longitudinal guiding portions 12 of the first bag panel 10 for guiding the air extracted from the longitudinal sealing portions 13 thereof.

Accordingly, a width of each longitudinal guiding portion 12 of the first bag panel 10 is larger than a width of each longitudinal sealing portion 13 thereof so as to prevent air bubble being formed within the longitudinal sealing portion 13 of the first bag panel 10.

In addition, the second bag panel 20 has a plurality of transverse guiding portions 22 and a plurality of transverse sealing portions 23 each formed between each two transverse guiding portions 22 wherein each of the transverse sealing portions 23 of the second bag panel 20 has a flat sealing surface for sealedly contacting with an item within the storing cavity 101 while the second air channels 32 are spacedly formed at the transverse guiding portions 22 of the second bag panel 20 for guiding the air extracted from the transverse sealing portions 23 thereof.

Likewise, a width of each transverse guiding portion 22 of the second bag panel 20 is larger than a width of each transverse sealing portion 23 thereof so as to prevent air bubble being formed within the transverse sealing portion 23 of the second bag panel 20.

According to the preferred embodiment, in order to manufacture the vacuum sealing bag of the present invention, an elongated bag sheet is formed wherein a plurality of grooves are longitudinally formed along the bag sheet. By cutting the bag sheet into a plurality of first and second bag panels 10, 20 having a corresponding size and shape, the grooves formed on the first bag panel 10 are embodied as the first air channels 31 while the grooves formed on the second panel 20 are embodied as the second air channels 32. Therefore, the second panel 20 is alignedly folded at a position that when the first bag panel 10 is overlapped on the second bag panel 20, the first air channels 31 are intersected with the second air channels 32. In other words, the manufacturing process of the vacuum sealing bag of the present invention is simplified and easy so as to reduce the manufacturing cost of the present invention.

Therefore, in order to sealedly pack the item in the vacuum sealing bag of the present invention, the user is able to dispose the item within the storing cavity 101 such that the surfaces of the item are respectively facing towards the inner sides 11, 21 of the first and second bag panels 10, 20. Then, by using a conventional vacuum pump to extract the air within the storing cavity 101 through the opening 102, the air is sucked until the surfaces of the item are contacted with the inner sides 11, 21 of the first and second bag panels 10, 20. At the same time, the air within the storing cavity 101 is guided to flow along the first and second air channels 31, 32 to outside until the air is completely extracted from the storing cavity 101.

It is worth to mention that when the surfaces of the item are sealedly contacted with the inner sides 11, 21 of the first and second bag panels 10, 20 respectively, no air bubble is formed between the surfaces of the item and the first and second bag panels 10, because the air is guided to flow along the first and second air channels 31, 32. In addition, when the inner sides 11, 12 of the first and second bag panels 10, 20 are overlapped to intersect the first air channels 31 with the second air channels 32, the air is guided to flow therealong such that no air bubble is formed between the first and second bag panels 10, 20, especially at the corner of the vacuum sealing bag.

Figure 4:
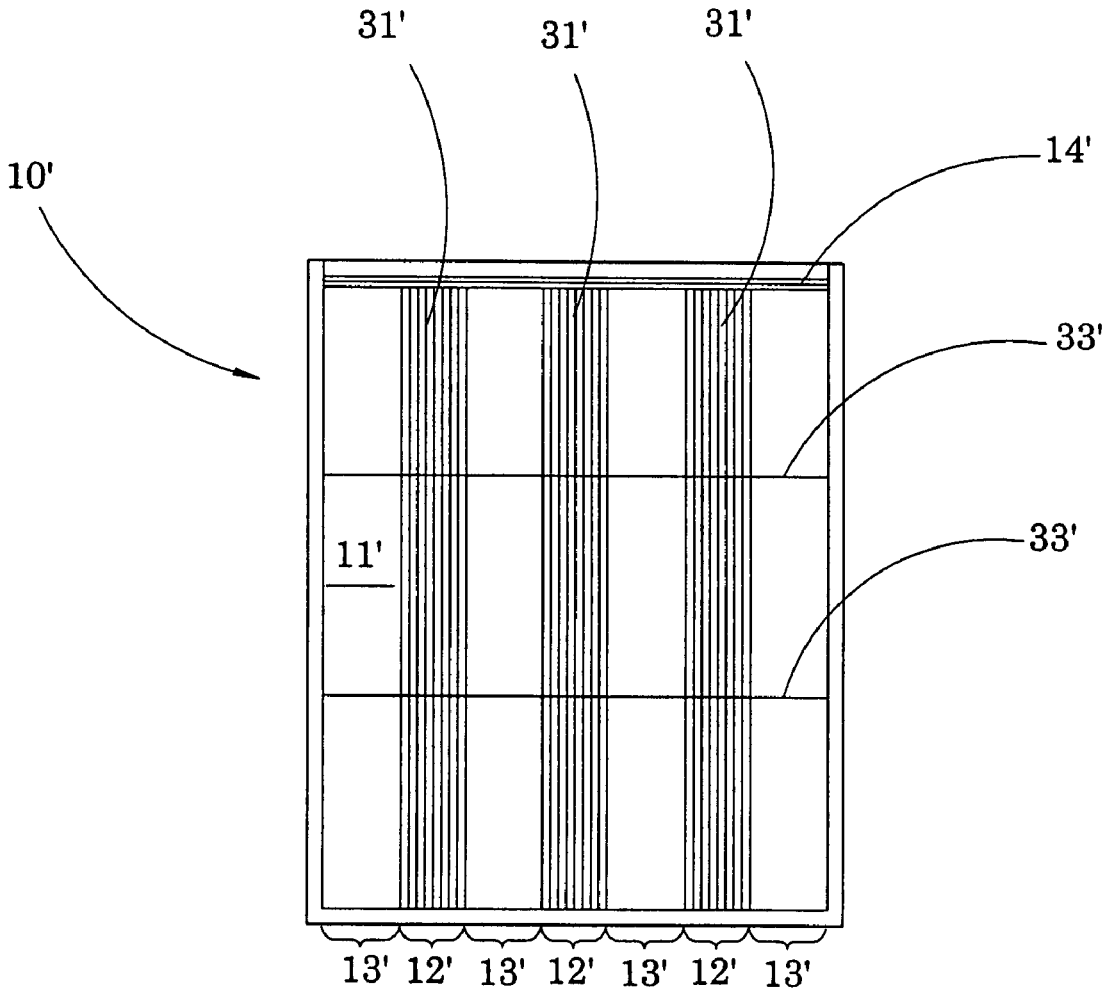
FIG. 4 is a schematic view of a first bag panel of a vacuum sealing bag according to a second preferred embodiment of the present invention, illustrating the air channels on the first bag panel.
Figure 5:
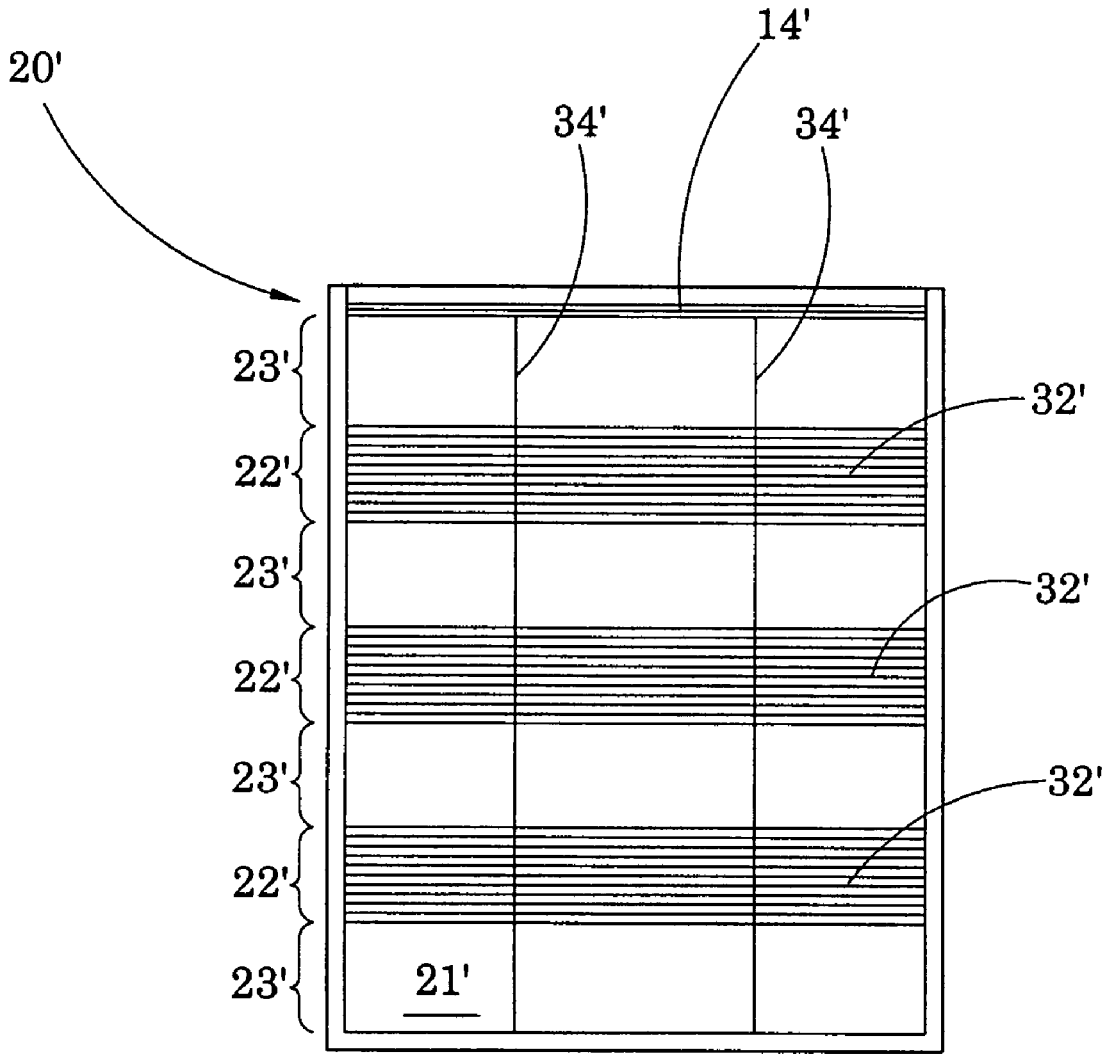
FIG. 5 is a schematic view of a second bag panel of a vacuum sealing bag according to a second preferred embodiment of the present invention, illustrating the air channels on the second bag panel.
Figure 6:
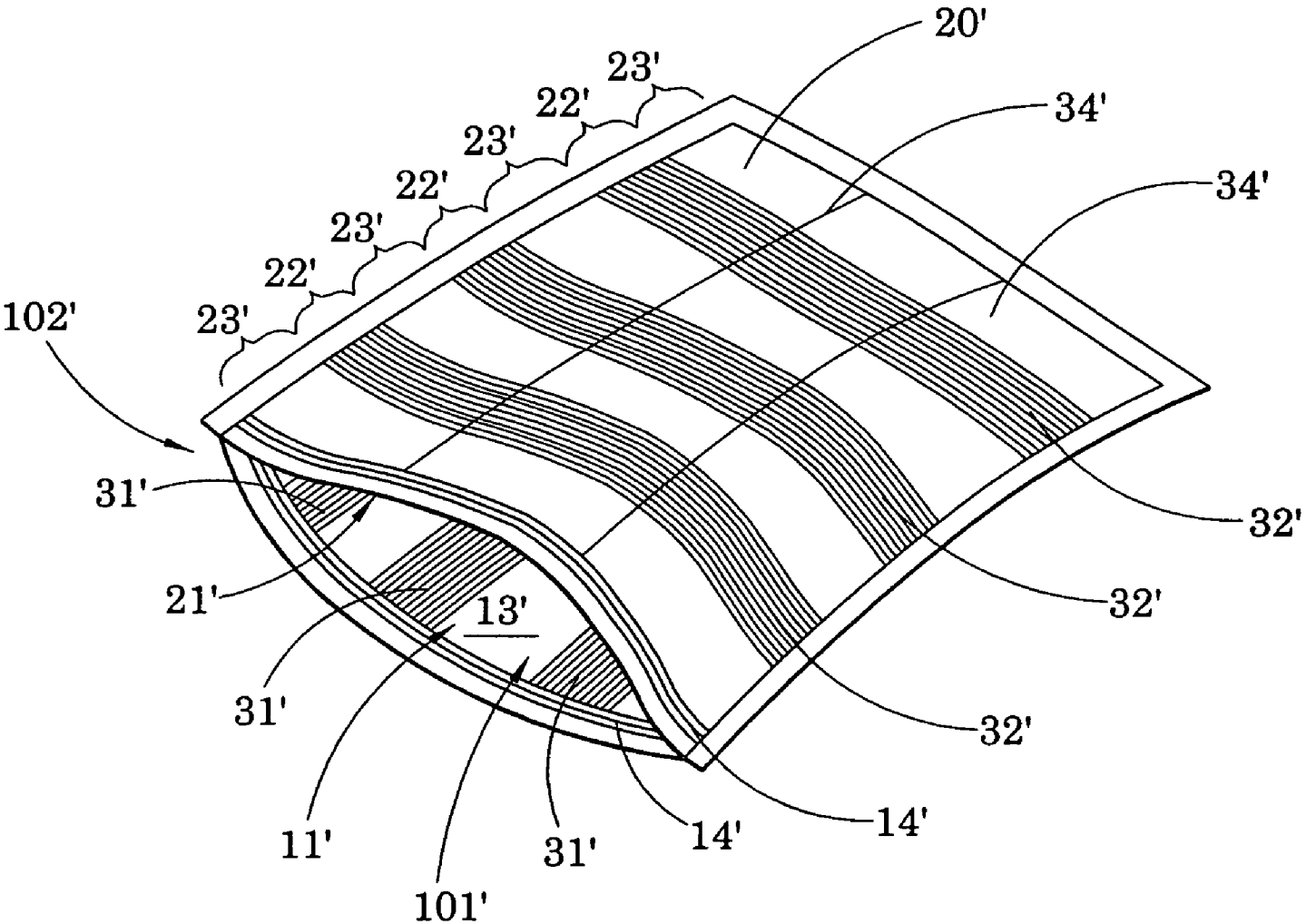
FIG. 6 is a perspective view of the vacuum sealing bag according to the above second preferred embodiment of the present invention.

As shown in FIGS. 4 to 6, a vacuum sealing bag of a second embodiment illustrates an alternative mode of the first embodiment of the present invention, wherein the vacuum sealing bag comprises first and second bag panels 10', 20' overlappedly affixed in an edge to edge manner to form a storing cavity 101' between the first and second bag panels 10', 20' and an opening 102' communicating with the storing cavity 101'. The vacuum sealing bag further comprises a pair of zip lockers 14' formed along the first and second bag panels 10', 20' at the opening 102' thereof to sealedly enclose the storage cavity 101'.

The vacuum sealing bag further comprises an air sealing arrangement 30' having a plurality of first air channels 31' transversely formed on an inner side 11' of the first bag panel 10' and a plurality of first communication channels 33' spacedly and longitudinally formed on the inner side 11' of the first bag panel 10' to communicatively intersect with the first air channels 31' in such a manner that when the opening 102' is sealed to enclose the storage cavity 101', the first air channels 31' with the first communication channels 33' are adapted for guiding the air within the storage cavity 101' to outside, so as to air-seal the storage cavity 101' in a vacuum manner.

According to the second embodiment, the first bag panel 10' has a plurality of transverse guiding portions 12' and a plurality of transverse sealing portions 13', wherein each of the transverse guiding portions 12' is formed between every two adjacent transverse sealing portions 13' such that the transverse guiding portions 12' and the transverse sealing portions 13' are transversely alternated on the inner side 11' of the first bag panel 10'. Accordingly, the transverse sealing portions 13' of the first bag panel 10' are transverse flat sealing surfaces respectively. Two of the transverse sealing portions 13' are provided at two edge portions of the first bag panel 10' respectively.

As shown in FIG. 4, the first air channels 31' are extended within the transverse guiding portions 12' of the first bag panel 10', wherein the first air channels 31' are parallelly extended on the inner side 11' of the first bag panel 10' from edge to edge at a position from the opening 102' of the first bag panel 10'.

The first communication channels 33' are parallely and evenly formed on the inner side 11' of the first bag panel 10' to perpendicularly intersect with the first air channels 31'. As shown in FIG. 4, there are two first communication channels 33' evenly formed on the first bag panel 10' at a position that the first bag panel 10' is evenly divided into three even longitudinal portions. It is worth to mention that the first communication channels 33' are intercommunicated with the first air channels 31' in a crisscross manner so as to allow the air to flow therebetween. In addition, a single first communication channel 33' formed on the inner side 11' of the first bag panel 10' to communicatively interest with the first air channels 31' is enough to guide the air communicatively flow between first air channels 31'. Preferably, two or more first communication channels 33' are formed on the first bag panel 10' to enhance the air-communication between the first air channels 31'.

It is worth to mention that the first air channels 31' can be evenly formed on the inner side 11' of the first bag panel 10', including the transverse guiding portions 12' and the transverse sealing portions 13', wherein the first communication channels 33' are air-communicated with the first air channels 31' to guide the air to flow therebetween.

As shown in FIG. 5, the an air sealing arrangement 30' further comprises a plurality of second air channels 32' longitudinally formed on an inner side 21' of the second bag panel 20' and a plurality of second communication channels 34' spacedly and transversely formed on the inner side 21' of the second bag panel 20' to communicatively intersect with the second air channels 32' in such a manner that when the opening 102' is sealed to enclose the storage cavity 101', the second air channels 32' with the second communication channels 34' are adapted for guiding the air within the storage cavity 101' to outside, so as to air-seal the storage cavity 101' in a vacuum manner. Accordingly, when the inner side 11' of the first bag panel 10' is overlapped on the inner side 21' of the second bag panel 20', the first air channels 31' are also communicatively intersected with the second air channels 32' for guiding air within the storing cavity 101' to outside, so as to air-seal the storing cavity 101' in a vacuum manner.

The second bag panel 20' has a plurality of longitudinal guiding portions 22' and a plurality of longitudinal sealing portions 23', wherein each of the longitudinal guiding portions 22' is formed between every two adjacent longitudinal sealing portions 23' such that the longitudinal guiding portions 22' and the longitudinal sealing portions 23' are longitudinally alternated on the inner side 21' of the second bag panel 20'. Accordingly, the longitudinal sealing portions 23' of the second bag panel 20' are longitudinal flat sealing surfaces respectively. Two of the sealing portions 23' are provided at top and bottom edge portions of the second bag panel 20' respectively.

The second air channels 32' are extended within the longitudinal guiding portions 22' of the second bag panel 20', wherein the second air channels 32' are parallelly extended on the inner side 21' of the second bag panel 20' from edge to edge at a position from one of the side edge of the second bag panel 20' to another opposed side edge thereof. The second communication channels 34' are parallely and evenly formed on the inner side 21' of the second bag panel 20' to perpendicularly intersect with the second air channels 32'. Preferably, when the first bag panel 10' is overlapped on the second bag panel 20', the first communication channels 33' are aligned with the longitudinal sealing portions 23' of the second bag panel 20' respectively while the second communication channels 34' are aligned with the transverse sealing portions 13' of the first bag panel 10' respectively.

Therefore, when the item is received in the storage cavity 101' of the vacuum sealing bag between the first and second bag panels 10', 20', two corresponding surfaces of the items are contacted with the inner sides 11', 21' of the first and second bag panels 10', 20'. When the air is sucked out from the storage cavity 101', the air is guided to flow along the first and second air channels 31', 32' and the first and second communication channels 33', 34', so as to maximize the amount of air in the storage cavity 101' be sucked out in a vacuum manner.

Figure 7:
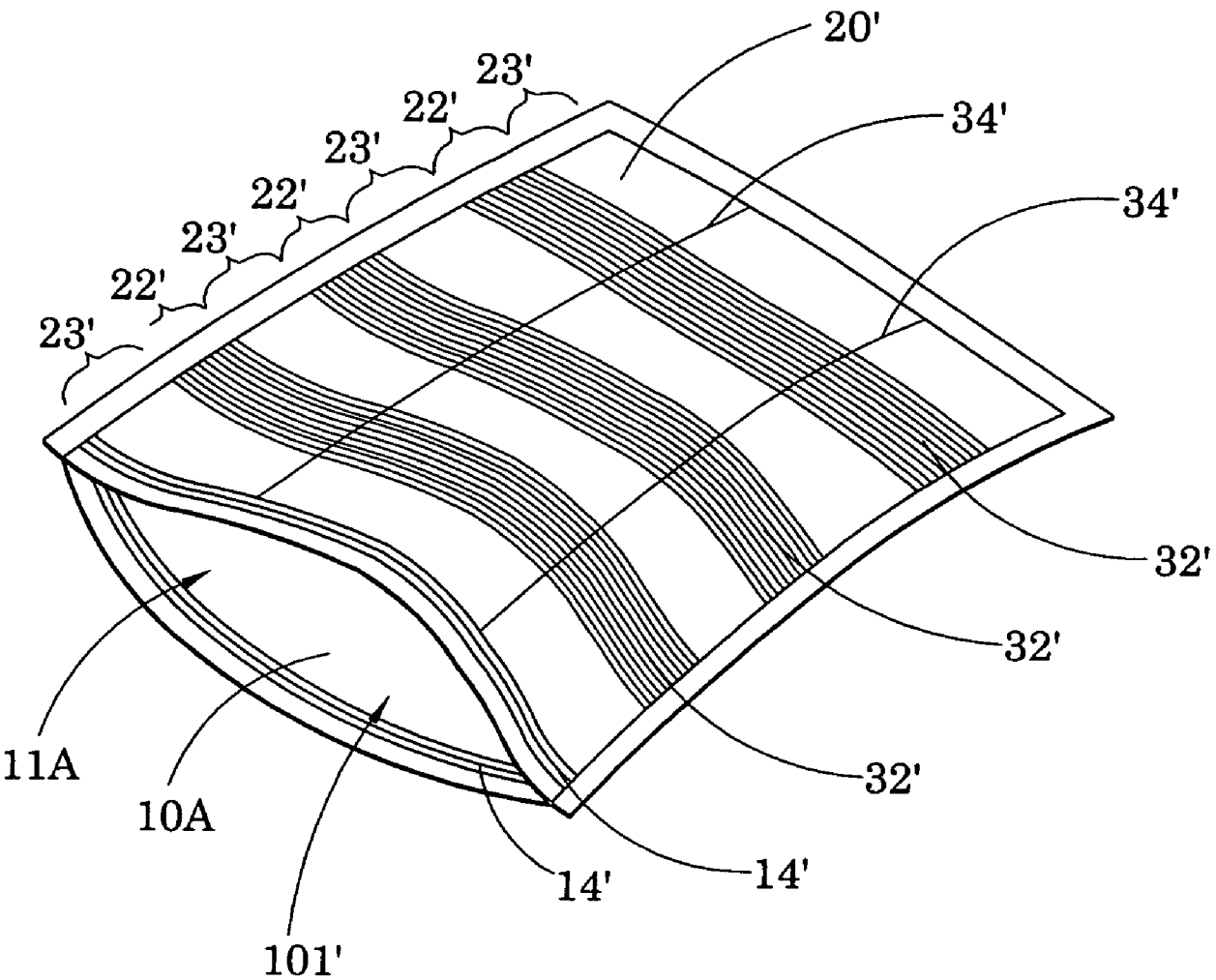
FIG. 7 illustrates an alternative mode of a second bag panel of the vacuum sealing bag according to the above second preferred embodiment of the present invention.

FIG. 7 illustrates an alternative mode of the first bag panel 10A, wherein the entire inner side 11A of the first bag panel 10A is a flat sealing surface to overlap with the inner side 21' of the second bag panel 20'. Therefore, the air in the storage cavity 101' is adapted to be sucked out therefrom through the second air channels 32' and the second communication channels 34' intercommunicating therewith.

Figure 8A:
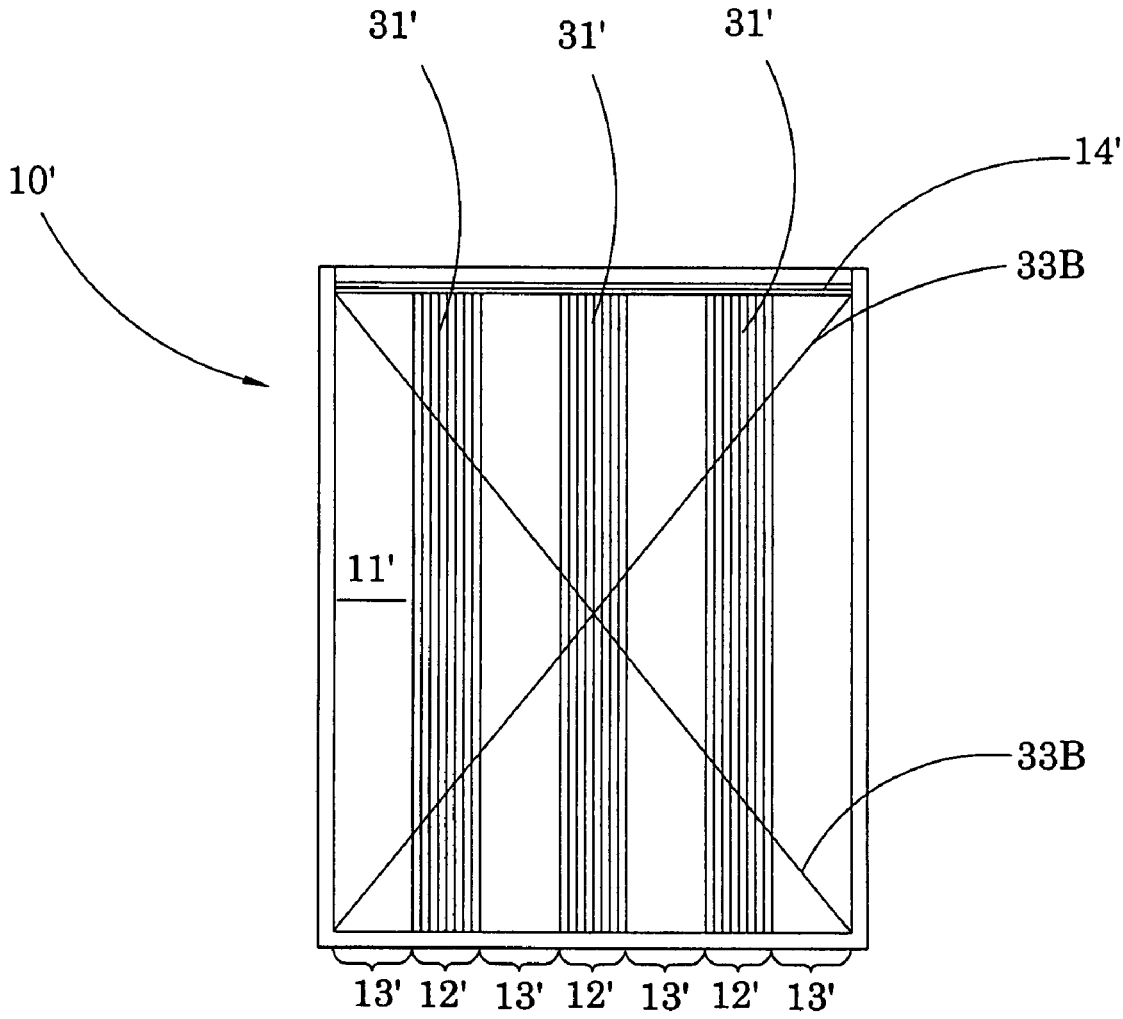
FIGS. 8A and 8B illustrate an alternative mode of a communication channel of the vacuum sealing bag according to the above second preferred embodiment of the present invention.

FIG. 8A illustrates an alternative mode of the first communication channels 33B, wherein the first communication channels 33B are extended on the inner side 11' of the first bag panel 10' in a crisscross manner. Accordingly, there are two first communication channels 33B formed on the first bag panel 10', wherein each of the communication channels 33B is diagonally extended on the inner side 11' of the first bag panel 10' to intercommunicate with the first air channels 31'.

Figure 8B:
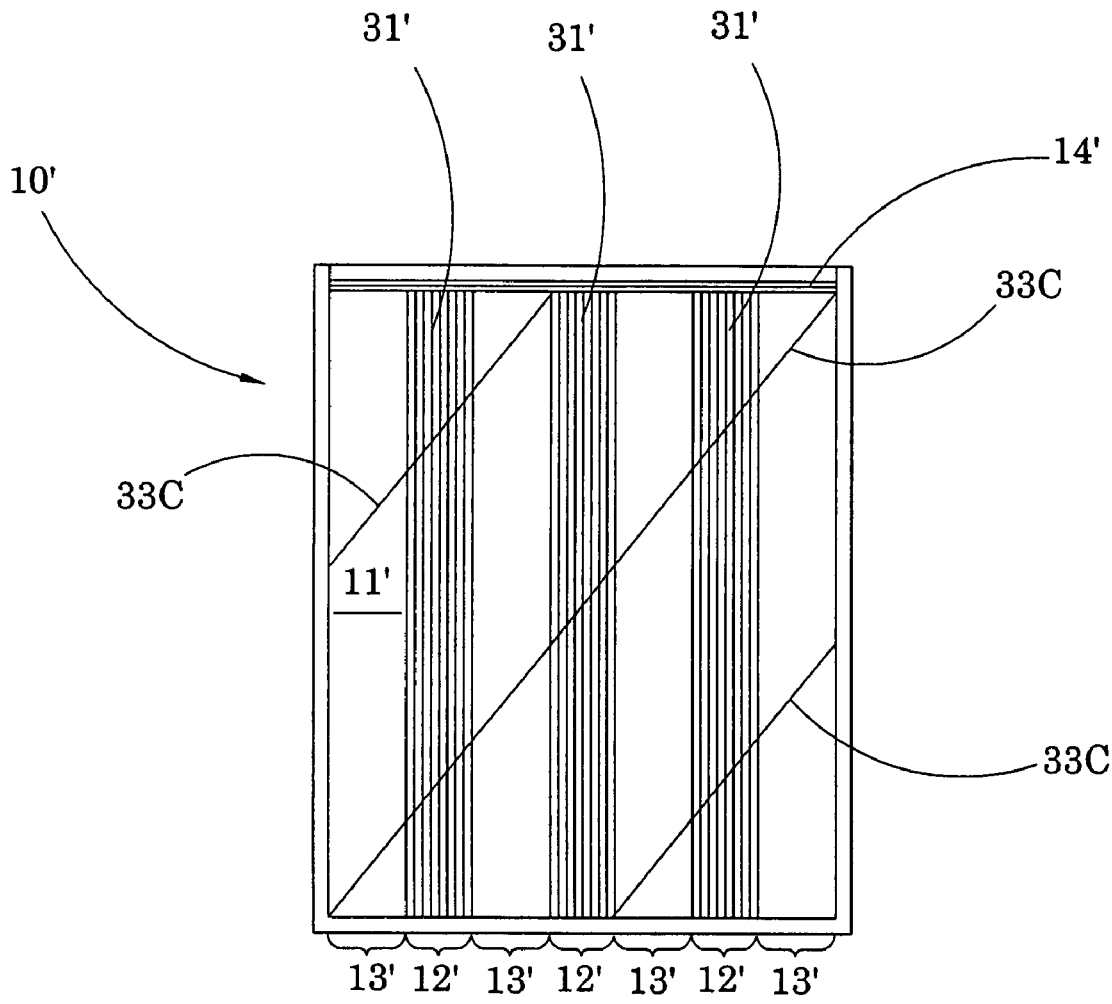

FIG. 8B illustrates another alternative mode of the first communication channels 33C, wherein the first communication channels 33C are parallelly extended on the inner side 11' of the first bag panel 10'. Accordingly, each of the first communication channels 33C is inclinedly extended on the inner side 11' of the first bag panel 10' with respect to the first air channel 11' so as to intercommunicate therewith.

Figure 9A:
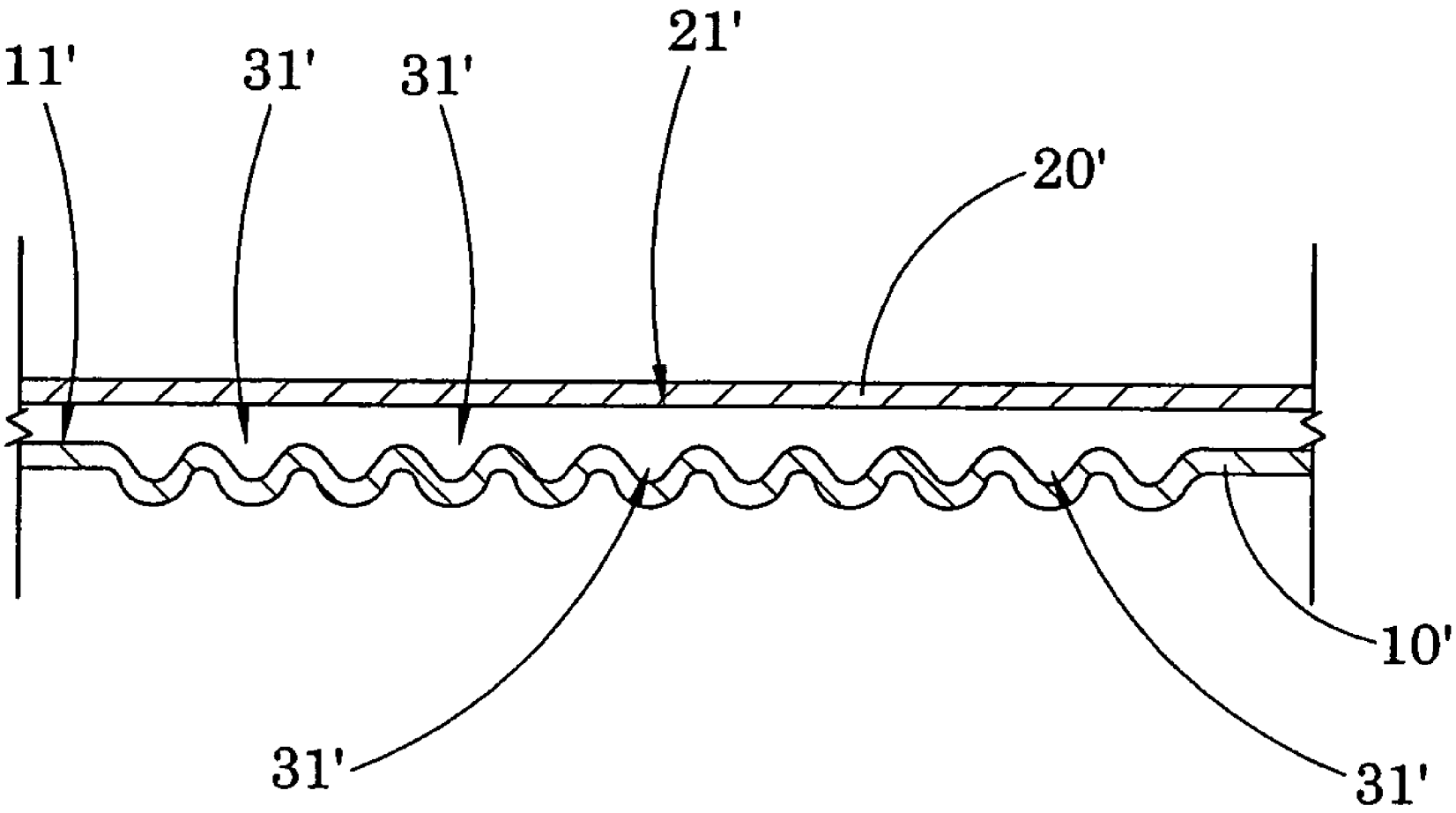
FIGS. 9A to 9E illustrate the air channel and its alternatives according to the above second preferred embodiment of the present invention.
Figure 9B:
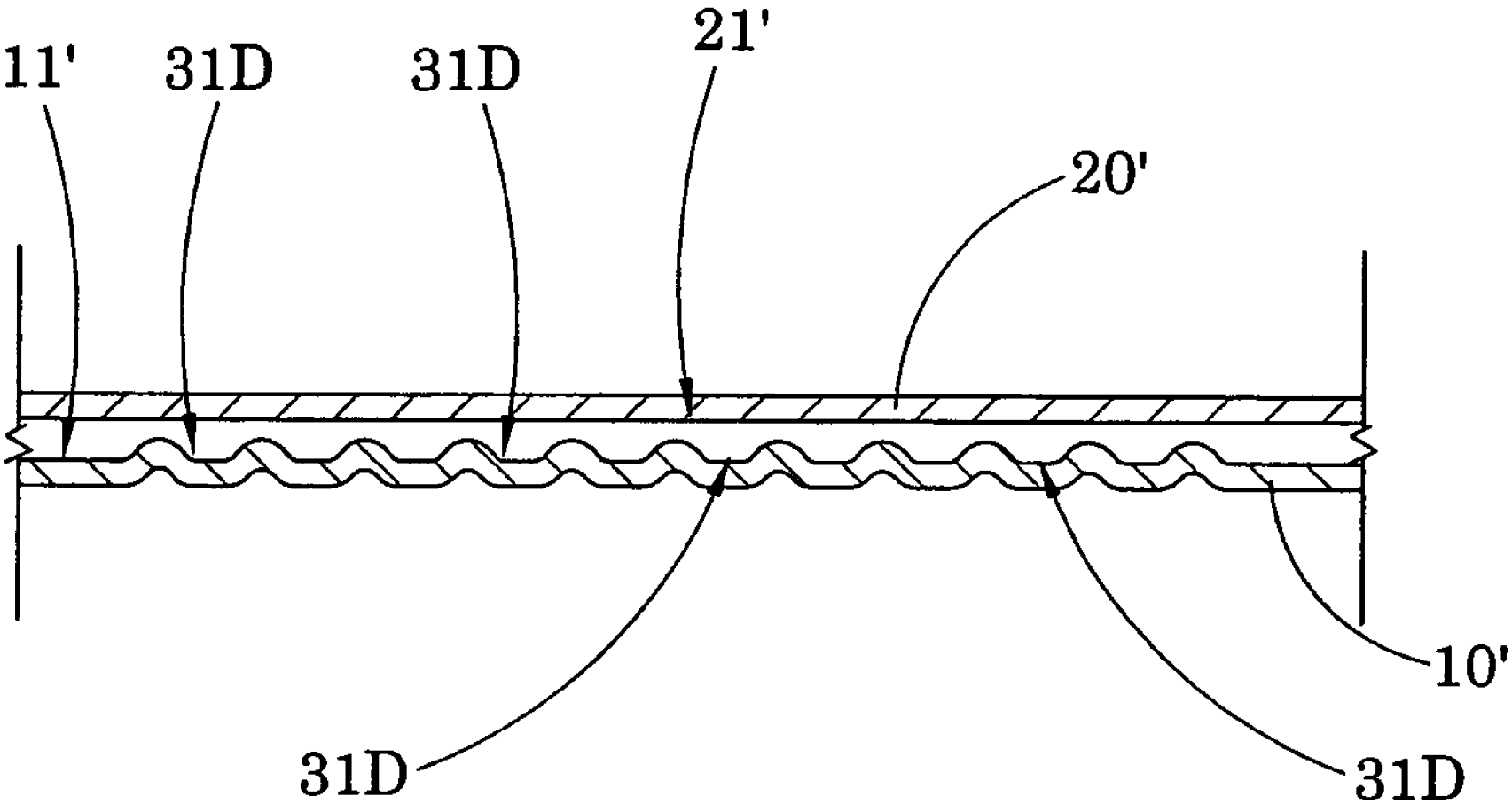

FIGS. 9A to 9E illustrate different profiles of the first air channel 31' and or the second air channel 32'. As shown in FIG. 9A, each of the first air channels 31' having a wavy shape indented on the inner side 11' of the first bag panels 10' to form the first air channels 31' respectively, such that the first air channels 31' are integrally formed on the inner side 11' of the first bag panel 10'. Likewise, each of the first air channels 31D having a wavy shape protruded on the inner side 11' of the first bag panels 10', as shown in FIG. 9B.

Figure 9C:
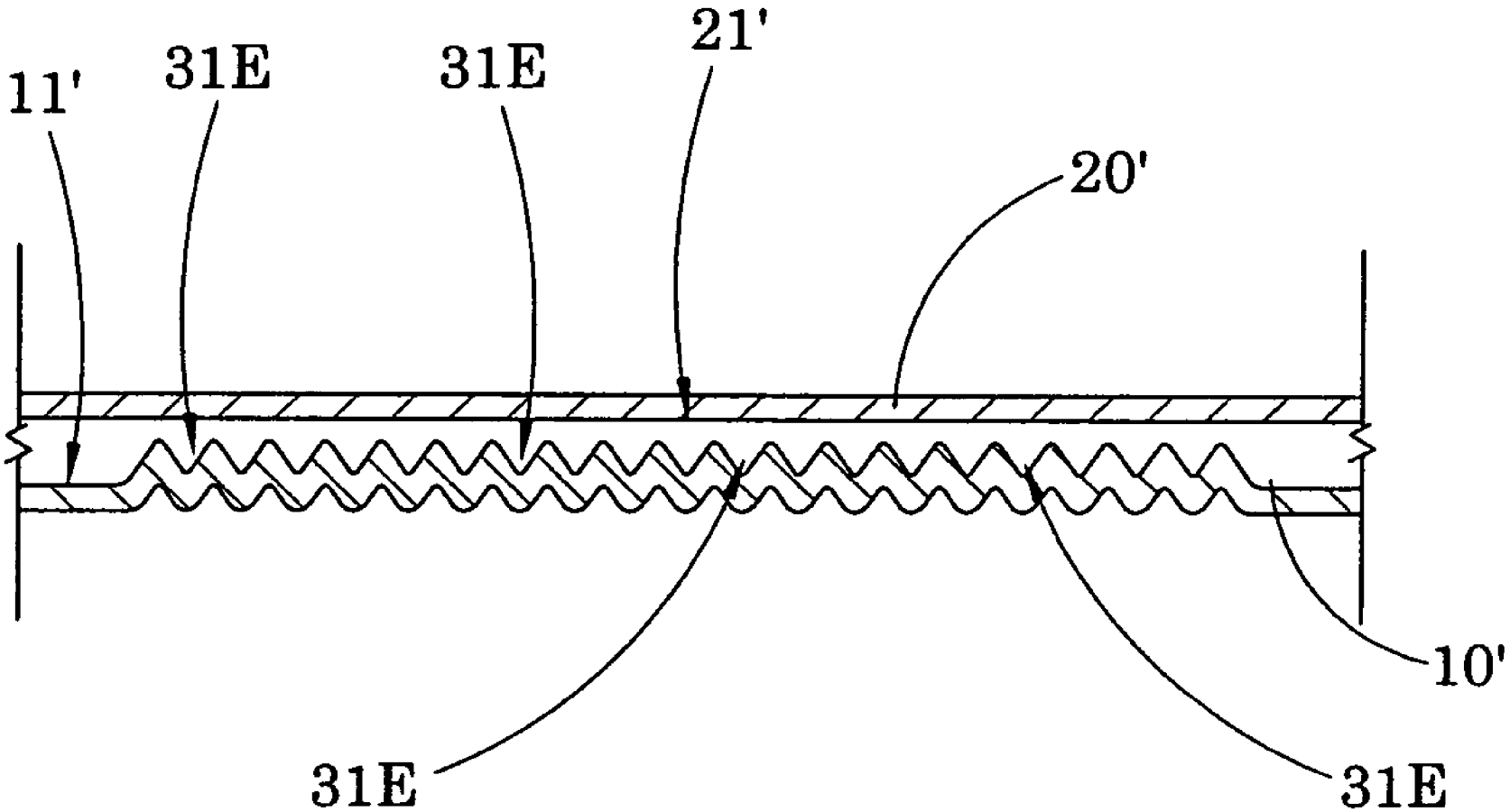
Figure 9D:
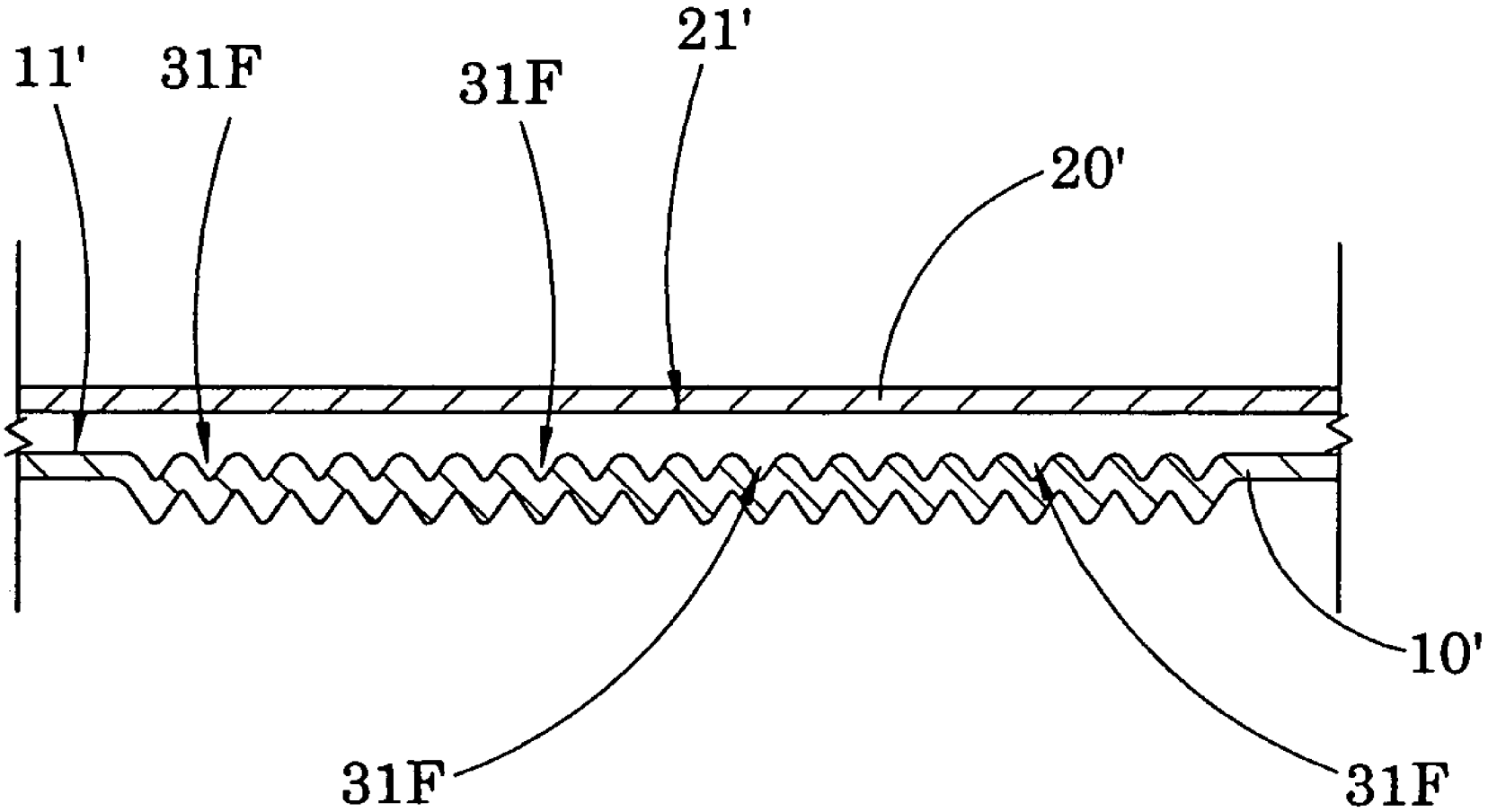
Figure 9E:
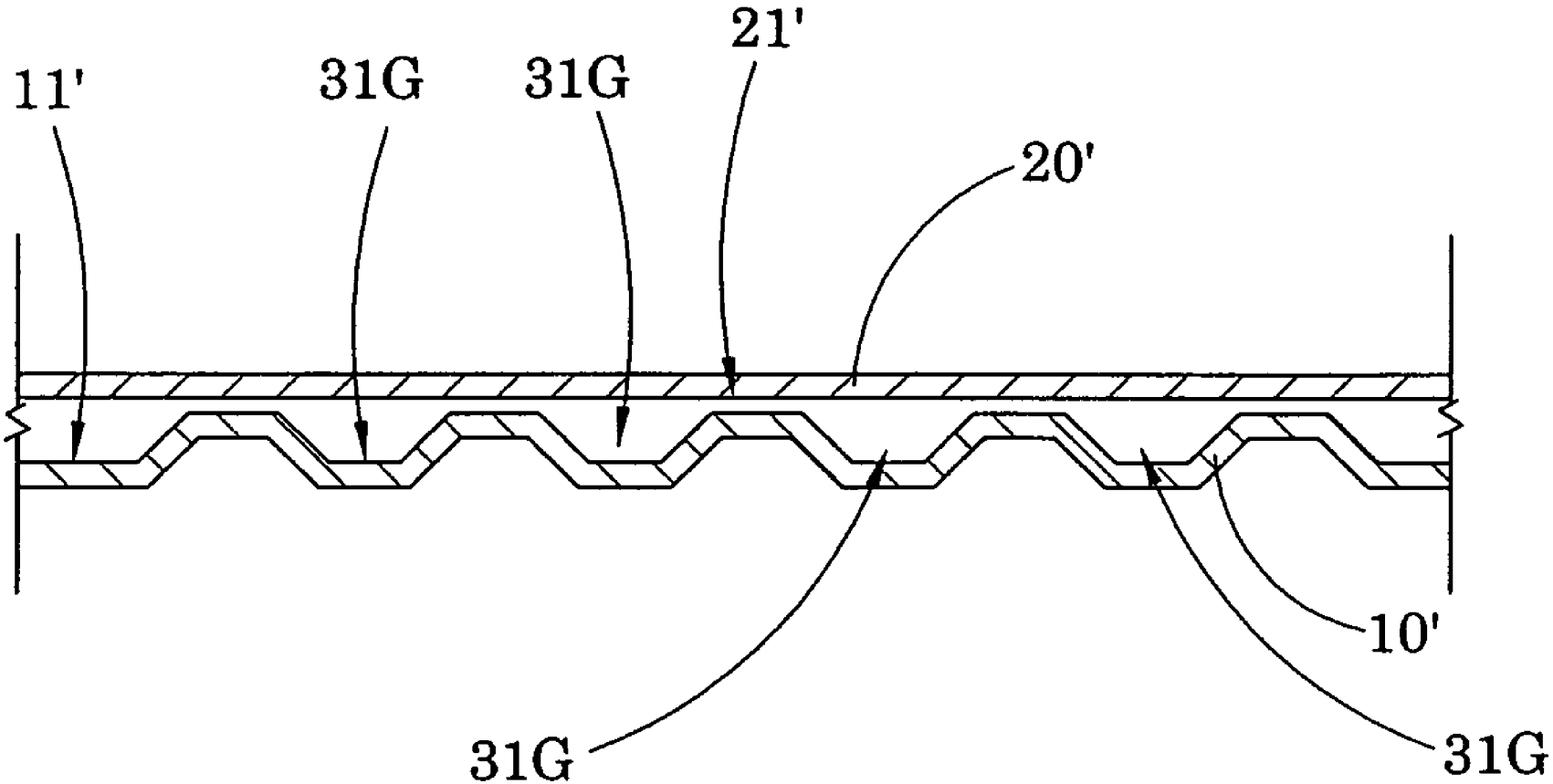

In addition, each of the first air channels 31E having a triangular shape indented on the inner side 11' of the first bag panels 10' to form the first air channels 31E as shown in FIG. 9C or each of the first air channels 31F having a triangular shape protruded on the inner side 11' of the first bag panels 10' to form the first air channels 31F as shown in FIG. 9D. Likewise, each of the first air channels 31G having a trapezoid shape protruded on the inner side 11' of the first bag panels 10' to form the first air channels 31G as shown in FIG. 9E.

Figure 10:
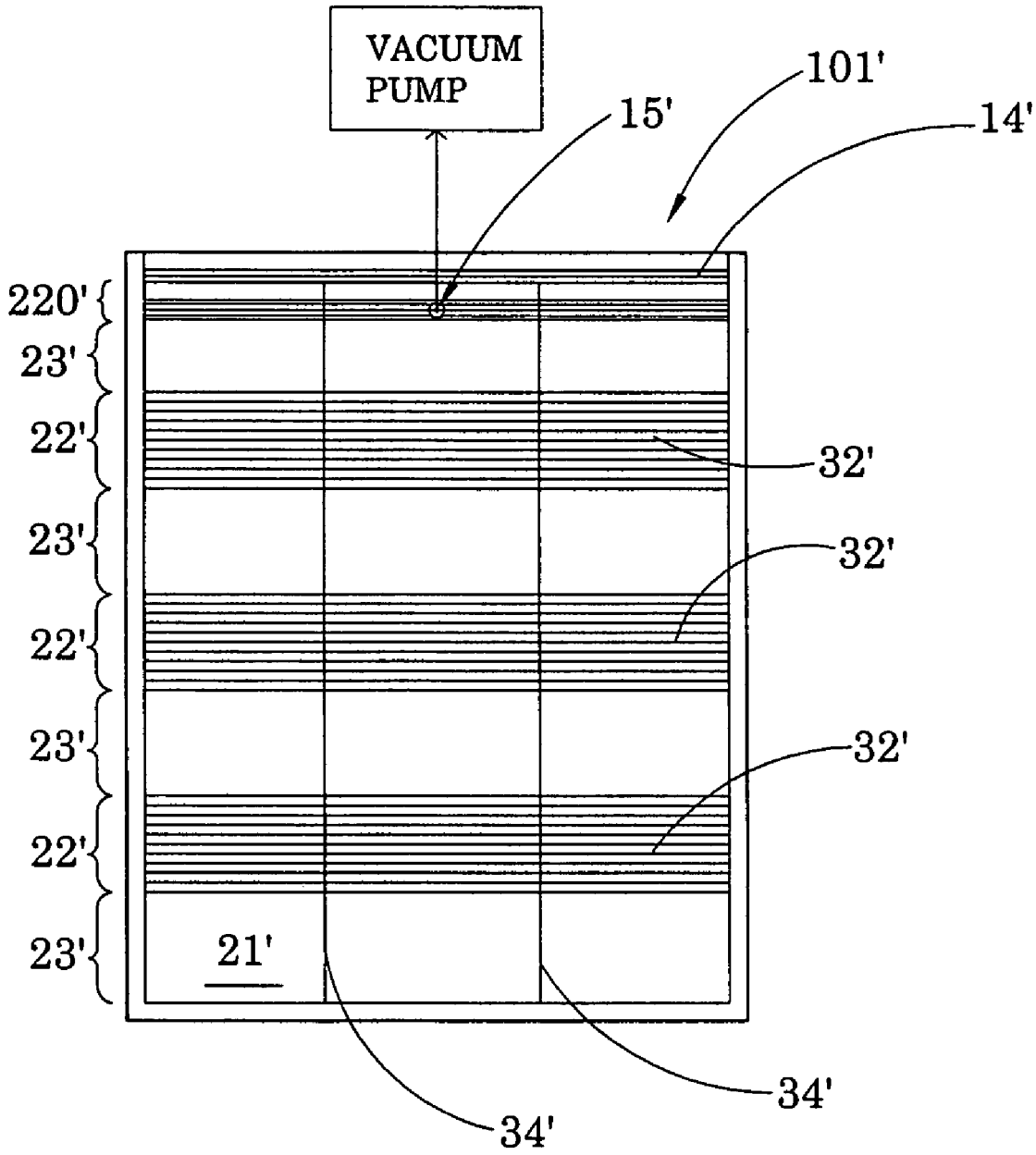
FIG. 10 illustrates an alternative mode of the second bag panel of the vacuum sealing bag according to the above second preferred embodiment of the present invention, illustrating the zip log type sealing bag.

FIG. 10 illustrate the vacuum sealing bag is a zip log type sealing bag, wherein The vacuum sealing bag further comprises a suction port 15' formed at the second panel 20' to communicate with the air sealing arrangement 30' for sucking the air within the storage cavity 102' out of the suction port 15' through the air sealing arrangement 30'.

As shown in FIG. 10, an additional longitudinal guiding portions 220' is provided at the inner side 21' of the second bag panel 20' at a positioned below the zip locker 14' thereof, wherein the suction port 15' is formed at the additional longitudinal guiding portions 220' of the second bag panel 20' at an outer side thereof to communicate with the second air channels 32'. Therefore, when the air is guided to flow along the first and second air channels 31', 32' and the first and second communication channels 33', 34', the air can be efficiently sucked out of the vacuum sealing bag through the suction port 15' via a vacuum device. Preferably, the suction port 15' is positioned close to the opening 101' that the zip locker 14' is provided thereat. It is worth to mention that the suction port 15', which is a one way air valve, can also formed at the outer side of the first bag panel 10' at the transverse guiding portions 12' thereof to communicate with the first air channels 31'.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

The invention claimed is:

1. A vacuum sealing bag for sealedly storing an item therein, comprising:

a first bag panel having two pairs of opposed edges, a plurality of first groove air channel sections longitudinally formed on an inner side of said first bag panel between two of said opposed edges thereof, and a plurality of first flat surface sections, wherein two of said first groove air channel sections are formed along said two corresponding opposed edges of said first bag panel, wherein said first groove air channel sections and said first flat surface sections are longitudinally alternated on said first bag panel, wherein a width of each of said first groove air channel sections of said first bag panel is larger than a width of each of said first flat surface sections thereof for preventing an air bubble being formed within said first flat surface section of said first bag panel;

a second bag panel, also having two pairs of opposed edges, overlappedly affixed on said first bag panel at a position that three of said edges of said first bag panel are sealed and affixed to three of said edges of said second bag panel respectively to form a storing cavity between said first and second bag panels and an opening between said edges of said first and second bag panels in an unsealed manner, wherein said second bag panel has a plurality of second groove air channels sections transversely formed on an inner side of said second bag panel between said two opposed edges thereof, and a plurality of second flat surface sections, wherein said first groove air channels sections are extended to said opening, wherein one of said second groove air channels sections is extended along said respective edge of said second bag panel at said opening, wherein said second groove air channel sections and said second flat surface sections are transversely alternated on said second bag panel, wherein a width of each of said second groove air channels of said second bag panel is larger than a width of each of said second flat surface sections thereof for preventing the air bubble being formed within said second flat surface section of said second bag panel, wherein said first groove air channel sections of said first bag panel being perpendicular to said second groove air channel sections of said second bag panel;

such that when said inner side of said first bag panel is overlapped with said inner side of said second bag panel, said first and said second bag panel characterize first through four sealing portions of said vacuum sealing bag, wherein said first sealing portion is defined by overlapping of said first groove air channel sections and second groove air channel sections in a cross manner respectively, said second sealing portion is defined by overlapping said first groove air channel sections with said second flat surface sections respectively, said third sealing portion is defined by overlapping said second groove air channel sections with said first flat surface sections respectively, and said fourth sealing portion is defined by overlapping said first flat surface sections with said second flat surface sections respectively, wherein when air in said storage cavity is sucked out through said opening, the air is guided to exit from said storage cavity through said first groove air channel sections and said second groove air channel sections to air-seal said storage cavity in a vacuum manner, and at the same time, when said air is sucked out from said storage cavity, said first flat surface sections of said first bag panel and said second flat surface sections of said second bag panel are adapted for sealedly contacting with the item to ensure that the item is effectively sealed in said storage cavity while minimizing the possibility of air trapping within said vacuum sealing bag, wherein said vacuum sealing bag further comprises an air sealing arrangement, which comprise at least a first communication channel longitudinally formed on said inner side of said first bag panel to communicatively intersect with said first groove air channel sections so as to intercommunicate therewith, wherein when said air is sucked out from said storage cavity, said first communication channel guides said air to flow between said first air channels for efficiently guiding said air flowing out of said storage cavity so as to ensure said item being sealed in said vacuum sealing bag, wherein said first communication channel is diagonally extended on said inner side of said first bag panel to intercommunicate with said first groove air channels sections.

2. The vacuum sealing bag, as recited in claim 1, wherein a plurality of spaced apart first air channels is indently formed along said first groove air channel sections of said first bag panel respectively, and a plurality of spaced apart second channels is indently formed along said second groove air channel sections of said second bag panel respectively, wherein when said inner side of said first bag panel is overlapped with said inner side of said second bag panel, said first air channels are communicatively intersected with said second air channels.

3. The vacuum sealing bag, as recited in claim 2, wherein said first air channels are parallelly extended on said inner side of said first bag panel from edge to edge and said second air channels are parallelly extended on said inner side of said second bag panel from edge to edge such that when said inner side of said first bag panel is overlapped on said inner side of said second bag panel, said first air channels are intercommunicated with said second air channels in a crisscross manner so as to allow said air to flow therebetween at said first sealing portion.

4. The vacuum sealing bag, as recited in claim 3, wherein each of said first and second bag panels is made of air impermeable material to prevent the air entering into said storing cavity after said storing cavity is air-sealed between said first and second bag panels.

5. The vacuum sealing bag, as recited in claim 1, wherein said first air channels are parallelly extended on said inner side of said first bag panel from edge to edge and said second air channels are parallelly extended on said inner side of said second bag panel from edge to edge such that when said inner side of said first bag panel is overlapped on said inner side of said second bag panel, said first air channels are intercommunicated with said second air channels in a crisscross manner so as to allow said air to flow therebetween at said first sealing portion.

6. The vacuum sealing bag, as recited in claim 5, wherein each of said first and second bag panels is made of air impermeable material to prevent the air entering into said storing cavity after said storing cavity is air-sealed between said first and second bag panels.

* * * * *